United States Patent [19]

Kamman

[11] Patent Number: 5,024,483

[45] Date of Patent: Jun. 18, 1991

[54] SWING ROCKER APPARATUS AND FURNITURE USING SAME

[76] Inventor: Zora R. Kamman, 19 Highland Dr., Peterborough, N.H. 03458

[21] Appl. No.: 439,412

[22] Filed: Nov. 20, 1989

Related U.S. Application Data

[63] Continuation-in-part of Ser. No. 258,158, Oct. 14, 1988, abandoned.

[51] Int. Cl.[5] ..... A47D 13/10

[52] U.S. Cl. ..... 297/273; 297/281; 248/370

[58] Field of Search ..... 297/273, 281, 282, 258, 297/259; 248/370, 341

[56] References Cited

U.S. PATENT DOCUMENTS

| | | | |
|---|---|---|---|
| 3,047,334 | 7/1962 | Vanderminden | 297/281 X |
| 3,994,468 | 11/1976 | Carter et al. | 297/281 X |
| 4,108,415 | 8/1978 | Hauray et al. | 297/273 X |
| 4,577,902 | 3/1986 | Crum | 297/259 X |
| 4,615,059 | 10/1986 | Darowski | 297/273 X |
| 4,700,920 | 10/1987 | Horn | 248/370 |
| 4,796,949 | 1/1989 | Boyce | 297/282 X |

FOREIGN PATENT DOCUMENTS

| | | | |
|---|---|---|---|
| 9085 | 4/1900 | Norway | 297/273 |
| 7915 | 1/1897 | Sweden | 297/273 |
| 8955 | of 1898 | United Kingdom | 297/273 |

*Primary Examiner*—Jose V. Chen

*Attorney, Agent, or Firm*—George W. Dishong

[57] ABSTRACT

A swing rocker apparatus adapted for the swingable and rockable attachment of a furniture piece base assembly to an upper portion assembly of the furniture piece whereby the base assembly is in fixed position relative to the surface upon which the base assembly rests. The swing rocker apparatus can be adapted to and attached to most any type of furnitured piece thereby converting it to a rocking or swinging furniture piece without noticeably or appreciably altering the basic appearance and aesthetics thereof. The apparatus comprises hanger members which are arcuately configured and which provide for the interconnection of a base and seat assembly of a furniture piece. The front to back spacing of the top ends of the front and the rear hangers is substantially the same as the front to back spacing of the bottom ends of the front and the rear hangers. There are also hanger stretchers which restrict or substantially eliminate rotation about an axis which is perpendicular to the floor. The apparatus, when incorporated into a chair limits the motion to one which is a more "to and fro" or gliding motion as compared with the rather large rotational and rocking motion.

10 Claims, 6 Drawing Sheets

SWING ROCKER APPARATUS AND FURNITURE USING SAME

This application is a continuation-in-part, of application Ser. No. 258,158, filed Oct. 14, 1988, now abandoned.

BACKGROUND OF THE INVENTION

1. Field of the Invention

This invention most generally relates to furniture which rocks and/or swings and more particularly to the mechanism or apparatus which permits the rocking and/or swinging motion. Most particularly this invention relates to a swing rocker apparatus which can be adapted to and attached to most any type of furniture piece thereby converting it to a rocking or swinging furniture piece without noticeably or appreciably altering the basic appearance and aesthetics thereof.

2. Description of the Prior Art

There is no other mechanism or apparatus known to the inventor hereof which can be used to convert, or which has been used to convert, for example, a straight wooden chair which does not swing or rock (in other words is rigid relative to the surface on which it rests) and which has the standard type of base assembly having legs and stretcher components and a seat and back assembly, into a rocker/glider furniture piece.

There are rocking chairs which have the standard and well known rocker members affixed to the bottom of the usual four legs. These rockers and other well known types of rockers are very disinctive in appearance and do not nor could they possibly look like, for example a basic four legged straight backed wooden chair which might be found in the kitchen of a home or in the office of a professional person. Further, these known types of rocking chairs/gliders are frequently not used where there may be the potential for injury, especially to small children who frequently play on the floor. Hands and feet etc. are easily caught under the rocker members or in the glider assembly.

It would be desirable to have a mechanism or apparatus which could be adapted to most standard types of furniture pieces converting them to so-called rockers. The mechanism should permit, or provide for, safe and pleasurable rocking and/or swinging. It would be desirable to be able to so adapt such furniture pieces as home or office type chairs, made of wood or other materials, sofas, couches, and even baby or infant pieces such as cribs, highchairs etc. With the apparatus disclosed and described herein, the above non-exclusive list of furniture pieces could be fitted so as to provide for safe, pleasurable rocking. It is obvious that not only could existing furniture pieces be fitted (or retrofitted) with the instant apparatus but also known designs as well as new designs, currently found in or planned for a rigid or non-rocking mode, could be manufactured having the apparatus of the instant invention incorporated therein. With the instant apparatus, the furniture piece would look substantially the same as the rigid piece. Applicant's invention has non-obvious features and combinations of features all of which make it new and advantageous over the known prior art. None of the known prior art have the advantages of and the features of Applicant's invention as disclosed herein.

It should be noted that during the conception and the development of the apparatus, considerable emphasis was placed on concerns of safety. Because of the unique design of the swing rocker apparatus, the well known rocker members of known types of rocking chairs and the heavy glider mechanism of the gliding type of chair have been eliminated.

SUMMARY OF THE INVENTION

The present invention in its most simple form or embodiment is directed to a means for providing for the swingable and rockable attachment of a furniture piece base assembly to an upper portion assembly of the furniture piece whereby the base assembly is in fixed position relative to the surface upon which the base assembly rests and said upper portion assembly is movable relative to said base assembly.

Applicant's invention is very particularly directed toward a mechanism which when attached to the seat back and base assembly of a furniture piece such as a typical chair converts that piece to a swinging or gliding chair. The appearance of the converted chair is very much like the chair before the incorporation of the mechanism. There is no need for the large components that connect the legs of the chair of the known prior art. The curved hanger members of Applicant's invention tends to reduce the likelihood of having fingers or a hand of a person seated in and moving the chair or a child, for example, crawling on the floor, being pinched in the mechanism. Additionally, Applicant's mechansim when incorporated into a chair limits the motion to one which is a more "to and fro" or gliding motion as compared with the rather large rotational and rocking motion.

It is a primary object of the present invention to provide an improved furniture piece having an upper portion assembly; a base assembly; a seat having an under side thereof; said improvement comprising a means for providing for the swingable and rockable attachment of said furniture piece base assembly to said upper portion assembly of the furniture piece whereby the base assembly is in fixed position relative to the surface upon which the base assembly rests.

It is another primary object of the present invention to provide a swing rocker apparatus for attachment to a furniture piece having a base assembly and an upper portion assembly whereby said base assembly is in fixed position relative to a surface upon which said base assembly rests and said upper portion assembly is movable relative to said base assembly said apparatus comprising: four low rotational friction attaching means adapted to be securely affixed to said base assembly; two pairs of hanger members a front pair and a rear pair each pair held in spaced relationship by a front hanger stretcher and a rear hanger stretcher, each of the four upper ends of said hanger members rotationally attachable to said four attaching means affixed to said base assembly, each hanger member of said two pairs of hanger members being configured so that when they are attached to said furniture piece said piece will be free of spaces defined by moving components which spaces are sufficiently large whereby injury to small body parts does not occur; a right and a left side frame each comprising a first and second side frame member said right and left side frames held in spaced relationship by a side frame stretcher, each of four bottom inward facing surfaces of said pairs of first and second side members having affixed thereto a low rotational friction attaching means each of said four attaching means affixed to said frame members adapted to receive a bottom end of one of said four hanger members and each of said first and second side frame members having an attaching surface which surface is adapted to be rigidly affixed to said upper portion assembly; and a front to back spacing of said top ends of said front and rear hangers being substantially the same as a front to back spacing of said bottom ends of said front and rear hangers.

It is yet another object of the invention to provide an improved rocker furniture piece having a seat back assembly; a base assembly having conventional legs and stretcher members; right and left side base members; a seat having an under side thereof; said improvement comprising: four low rotational friction attaching means adapted to be securely affixed to the inward facing surface of the right and left side base members, one of the attaching means toward the front portion and one toward the rear portion of each sided base member and each attaching means adapted to receive an upper end of one of four hanger members; two pairs of hanger members a front pair and a rear pair each pair held in space relationship by a front hanger stretcher and a rear hanger stretcher, each of the four upper ends of said hanger members rotationally attachable to said four attaching means affixed to said base assembly, each hanger member of said two pairs of hanger members being configured so that when they are attached to said furniture piece said piece will be free of spaces defined by moving components which spaces are sufficiently large whereby injury to small body parts does not occur; and a right and a left side frame each comprising a first and second side frame member the right and left side frames held in space relationship by a side frame stretcher, each of the four bottom inward facing surfaces of the pairs of first and second side members having affixed thereto a low rotational friction attaching means each attaching means adapted to receive a bottom end of one of four hanger members and each of the first and second side frame members having a seat attaching surface which surface is adapted to be rigidly affixed to the underside of the seat.

It is yet another primary object of the invention to provide the improved rocker furniture piece wherein the front to back spacing of top ends of said front and rear hangers being substantially the same as the front to back spacing of bottom ends of said front and rear hangers. The right and left side frames are each configured in the shape of an X member and said side frame stretcher is attached, at each of its ends, to the cross-over of each of said side frame X member. The two pairs of hanger members are made from material selected from the group consisting of wood, steel, aluminum and rigid polymers and are arcuately configured with an inward directed radius of curvature and said arcuate portion of said hanger members being located inwardly of said four attaching means affixed to said frame members by a predetermined distance. The low rotational friction attaching means may be bearing assemblies.

These and further objects of the present invention will become apparant to those skilled in the art after a study of the present disclosure of the invention.

DESCRIPTION OF THE PREFERRED EMBODIMENTS

Figure 1:
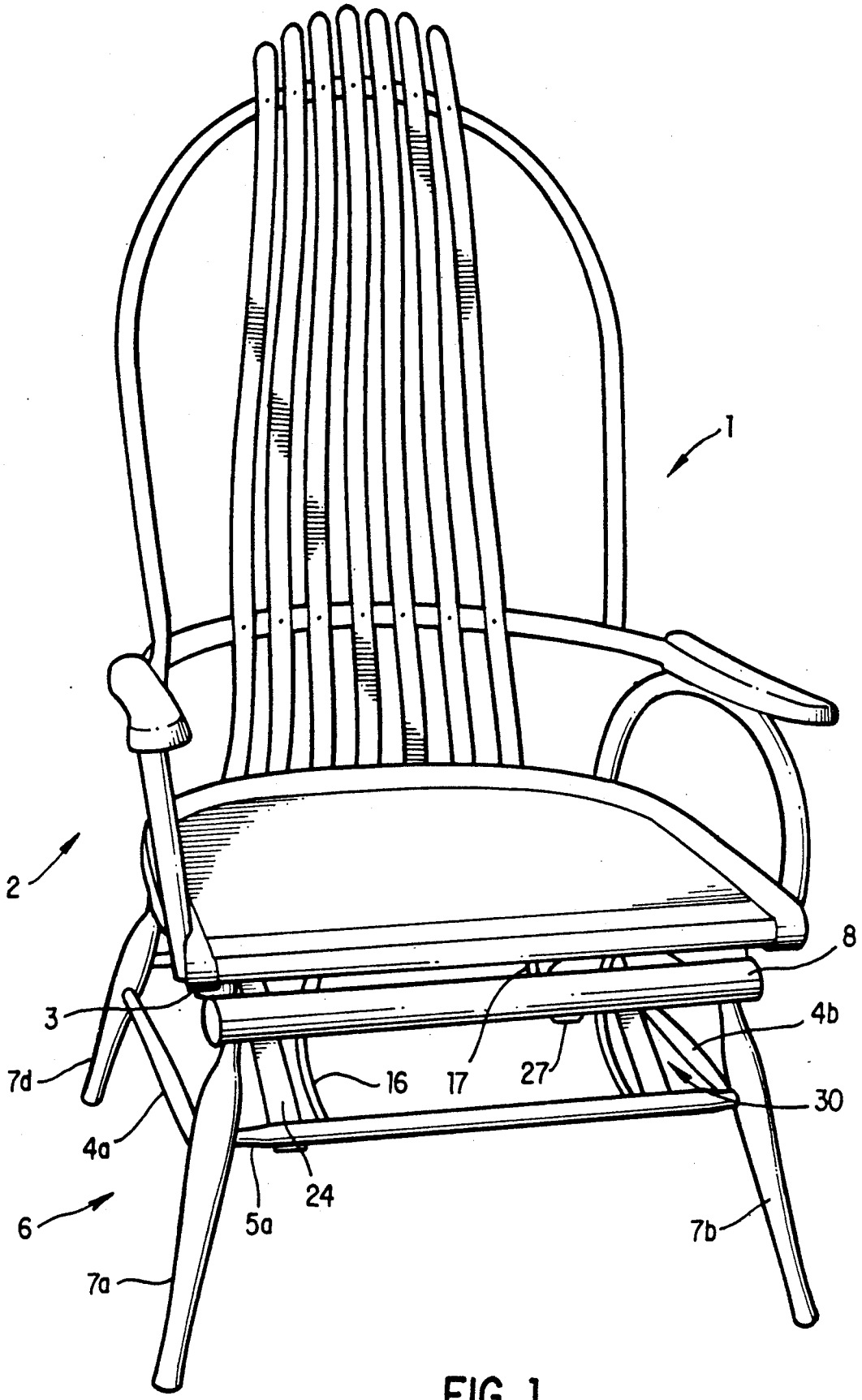
FIG. 1 is a perspective of a wooden chair of novel design having incorporated the swing rocker apparatus.
Figure 2:
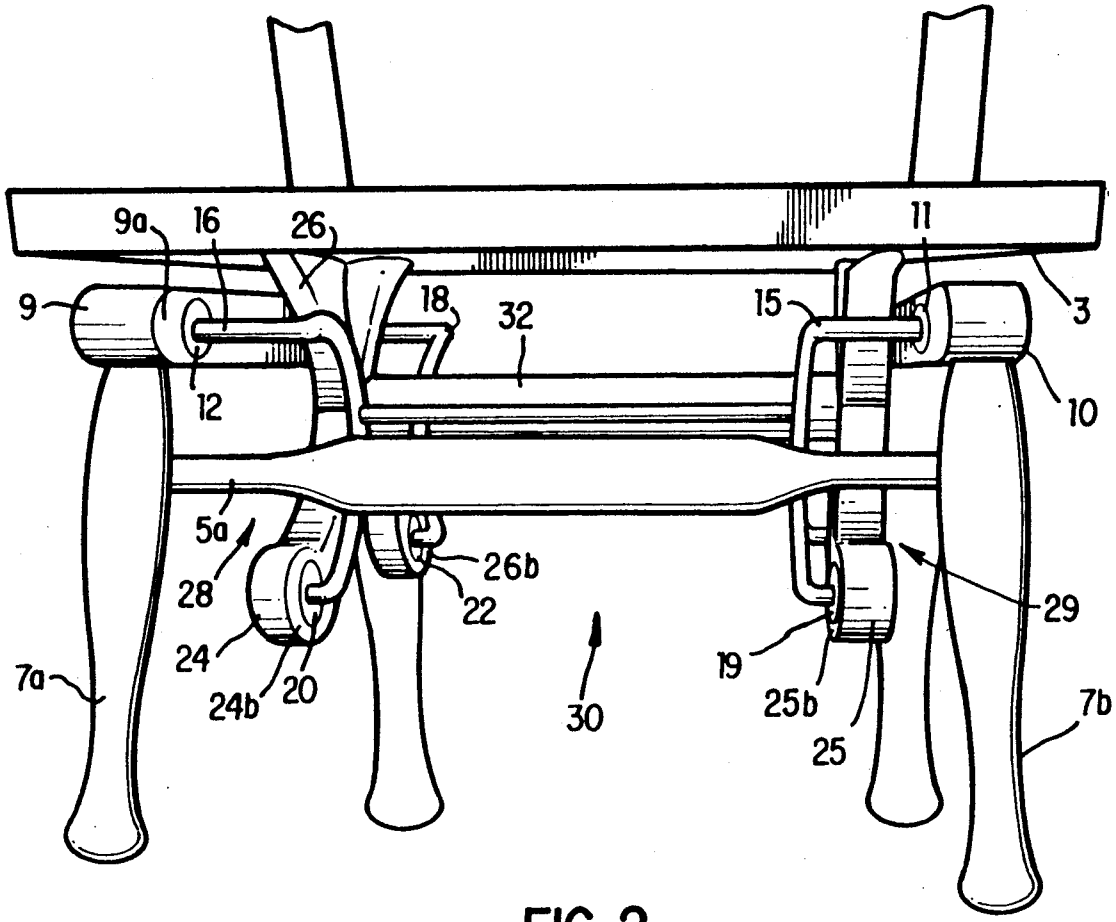
FIG. 2 is an exploded perspective of the apparatus shown attached to the base assembly and the seat assembly of a typical wooden chair.
Figure 3:
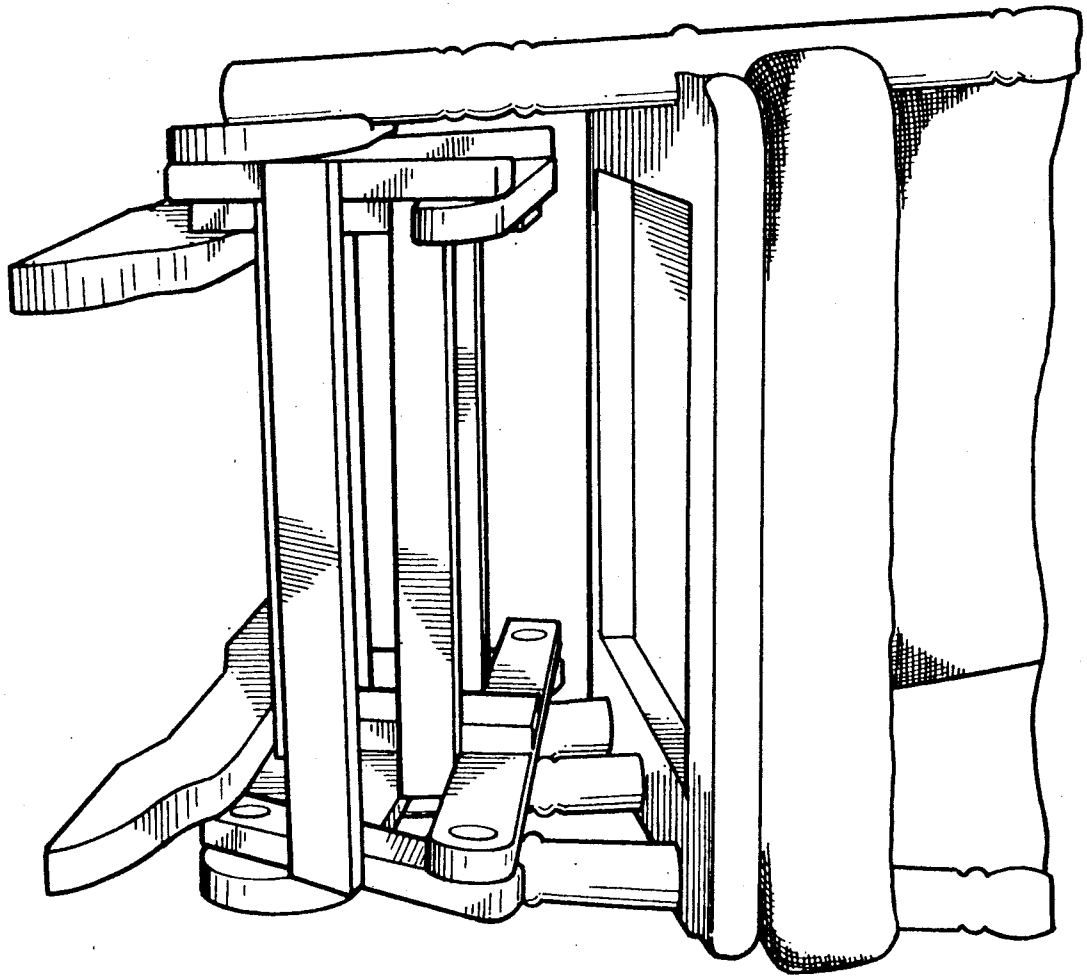
FIG. 3 PRIOR ART
FIG. 3 is an exploded perspective of a prior art type of rocker assembly used to make such furniture pieces rockable.

The following is a description of the preferred embodiment of the invention. While the swing rocker apparatus is illustrated as being incorporated into a wooden chair which ordinarily would be rigid, i.e., non-rocking or swinging it is obvious that the apparatus could be incorporated into a wide variety of furniture pieces including but not limited to; home or office type chairs, made of wood or other materials, sofas, couches, and even baby or infant pieces such as cribs, highchairs, strollers, cradles etc.. For furniture pieces different from such as chairs, the swing rocker apparatus provides the swingable and rockable connection between a base assembly and an upper assembly. The upper assembly in the case of a chair would be called herein the seat back assembly. It is also obvious to one of ordinary skill in the relevant art, that the configuration of the swing rocker apparatus as is shown in the drawing figures is not the only configuration that is effective in achieving the purpose and function of the instant invention. Clearly, the configuration of the right and left side frame need not have the "X"-shape as is shown. The shape of not only the side frame but also the hangers is a function of, among other things, the aesthetics and the location of such things as the stretchers and the legs of the base assembly of the furniture piece into which the apparatus is to be incorporated. The materials used to make the swing rocker apparatus could be for example, steel, or any other material which would provide the structural strength necessary to achieve the intended purpose of the furniture piece such as aluminum and appropriate plastics. Particularly, the material used for the hangers may be, or is, selected from those materials skilled artisans in the relevant art would obviously choose. The drawing figures explicitly, or at least implicity, disclose that the hangers are of material other than wood which material would obviously have to be appropiate plastics, steel and even aluminum.

Additionally, other means different from the bearings into which the ends of the hangers are inserted could be used to provide for a low friction associated with the rotation of the hangers when the chair or other furniture piece undergoes a rocking or swinging motion. Metal (e.g., bronze) or plastic sleeves and the like positioned into the base assembly and the side frame members into which the hanger ends are placed, would provide a low friction attachment. For the purpose of providing a clear illustration, the apparatus will be described primarily with regard to the configuration of the elements as is shown in the drawings—incorporated into a wooden chair having four conventional type legs, stretchers etc. and using bearings.

FIGS. 1, 2, 4–8 illustrate in several views the apparatus and its function. They also illustrate how the apparatus 30 is incorporated into a particular furniture piece 1. FIG. 1 shows the swing rocker apparatus 30 providing the swingable or rockable connection of the seat back assembly 2 and the base assembly 6. The seat underside 3 is attached to the apparatus 30 at the surfaces 24*a*, 25*a*, 26*a* and 27*a* which surfaces are at the top portion of right and left side first and second frame members 24, 25, 26 and 27 respectively. The apparatus 30 is connected to the base assembly 6 by interfitting or inserting the top ends of hangers 15, 16, 17 and 18 into bearings 11, 12, 13 and 14 (11*a*, 12*a*, 13*a* and 14*a* shown as sleeve bearings in FIG. 8) which bearings are mounted or attached to the inside surface 9*a*, 9*b*, 10*a* and 10*b* of the right and left side base members 9 and 10 respectively. As is illustrated at least in FIGS. 4–8, the distance between bearings 11 and 13 is substantially the same as the distance between bearings 19 and 21. Also, the distance between bearings 12 and 14 is substantially the same as the distance between bearings 20 and 22. The bottom ends of hangers 15, 16, 17 and 18 are interfitted or inserted into bearings 19, 20, 21 and 22 (19*a*, 20*a*, 21*a* and 22*a* shown as sleeve bearings in FIG. 8) respectively which bearings are mounted or attached to the inside surfaces 25*b*, 24*b*, 27*b* and 26*b* respectively.

The legs 7*a*, 7*b*, 7*c* and 7*d* are conventionally attached to members 9 and 10 and are supported and reinforced by the known elements as right side stretcher 4*a*, a left side stretcher 4*b*, front center stretcher 5*a* and rear center stretcher 5*b*. The rocking stops 38 merely serve to limit the excursion of the motion of the seat back assembly 2 relative to the base assembly 6. While the front and rear hanger stretchers 34 and 36 respectively are not essential to the apparatus 30, they add a degree of strength and stability to the furniture piece 1 having the apparatus 30 incorporated therein.

The particular furniture piece 1 shown in FIG. 1 also depicts a front base member 8. The legs 7, the base stretchers 4 and 5, the right and left side base members 9 and 10 are all conventional and standard components of the base assembly 6 of most chair type furniture pieces. It is important that it be noted that the apparatus 30 is relatively unobtrusive and does not substantially affect the aesthetics of the furniture piece 1. The right side "X"-frame 28 and the left side "X"-frame 29 need not be configured in the form of an "X". It is also not necessary that the hangers 15, 16, 17 and 18 have the curvatures and the smoothly bent rod type configuration in order for the apparatus 30 to properly function. The shape of both the side frames 28 and 29 and the hangers 15–18 may be determined by the designer of the furniture piece so long as the mechanical requirements of the piece are satisfied.

Figure 4:
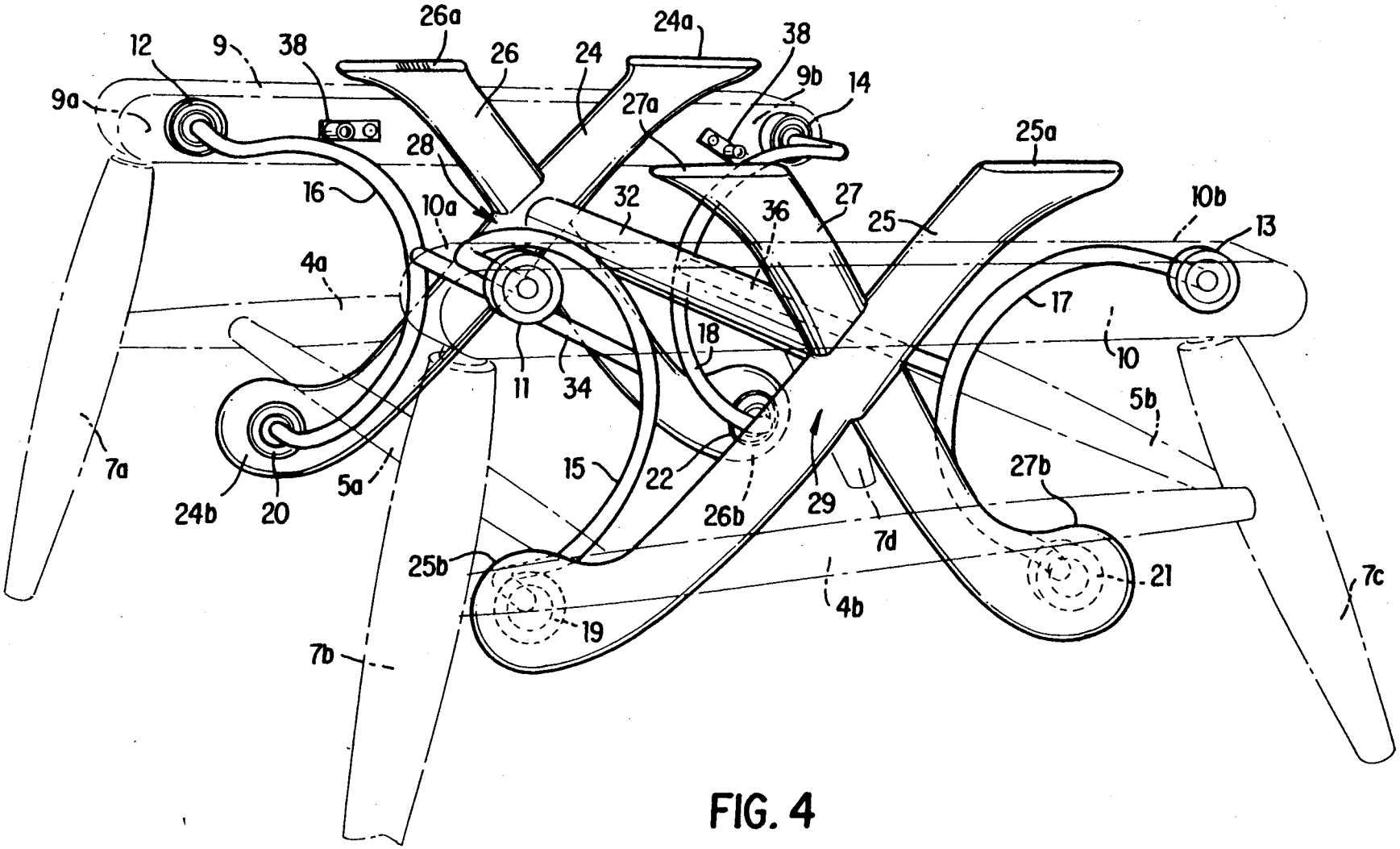
FIG. 4 is a side perspective view, in silhouette, of an embodiment of the swing rocker apparatus illustrating the relative location of the apparatus to the conventional base assembly components of a four legged chair.
Figure 5:
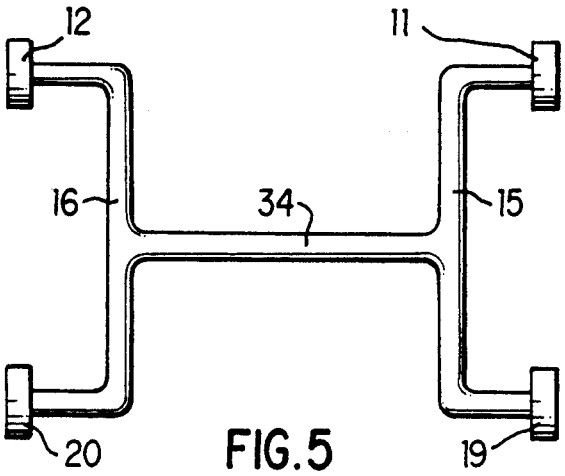
FIG. 5 is a front elevation of the hanger assembly.
Figure 6:
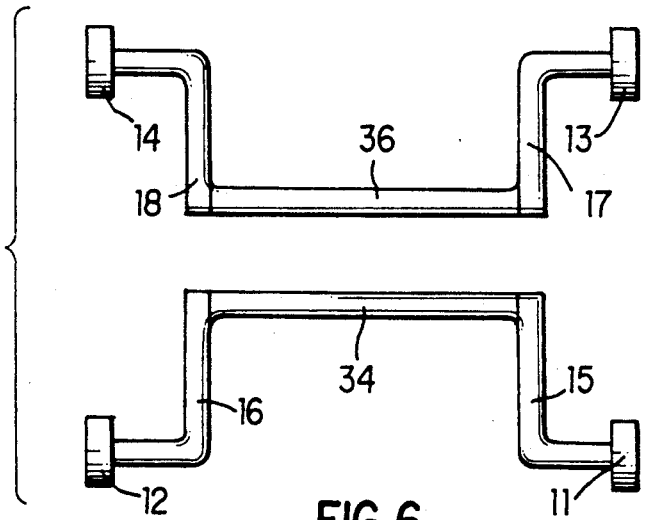
FIG. 6 is a top elevation of the hanger assembly illustrating the relative position of the front and the rear hanger assemblies.
Figure 7:
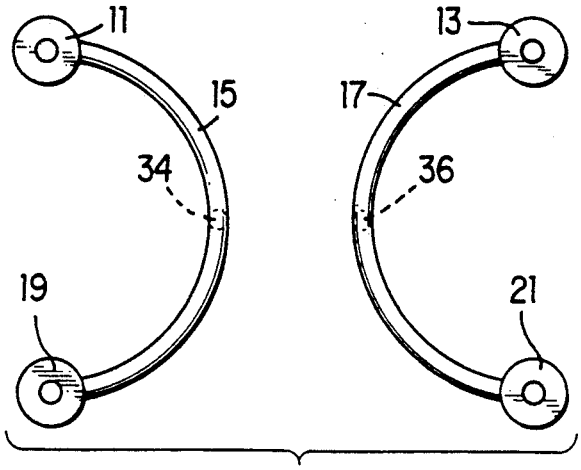
FIG. 7 is a side elevation of the hanger assemblies illustrating the arcuate characteristics and the feature that the front to back spacing of the top ends of the front and the rear hangers is substantially the same as the front to back spacing of the bottom ends of the front and the rear hangers and FIG. 8 is a side perspective view of an embodiment of the swing rocker apparatus illustrating the relation of the hanger assemblies with the "X" frame members and illustrating a type of bearing assembly.
Figure 8:
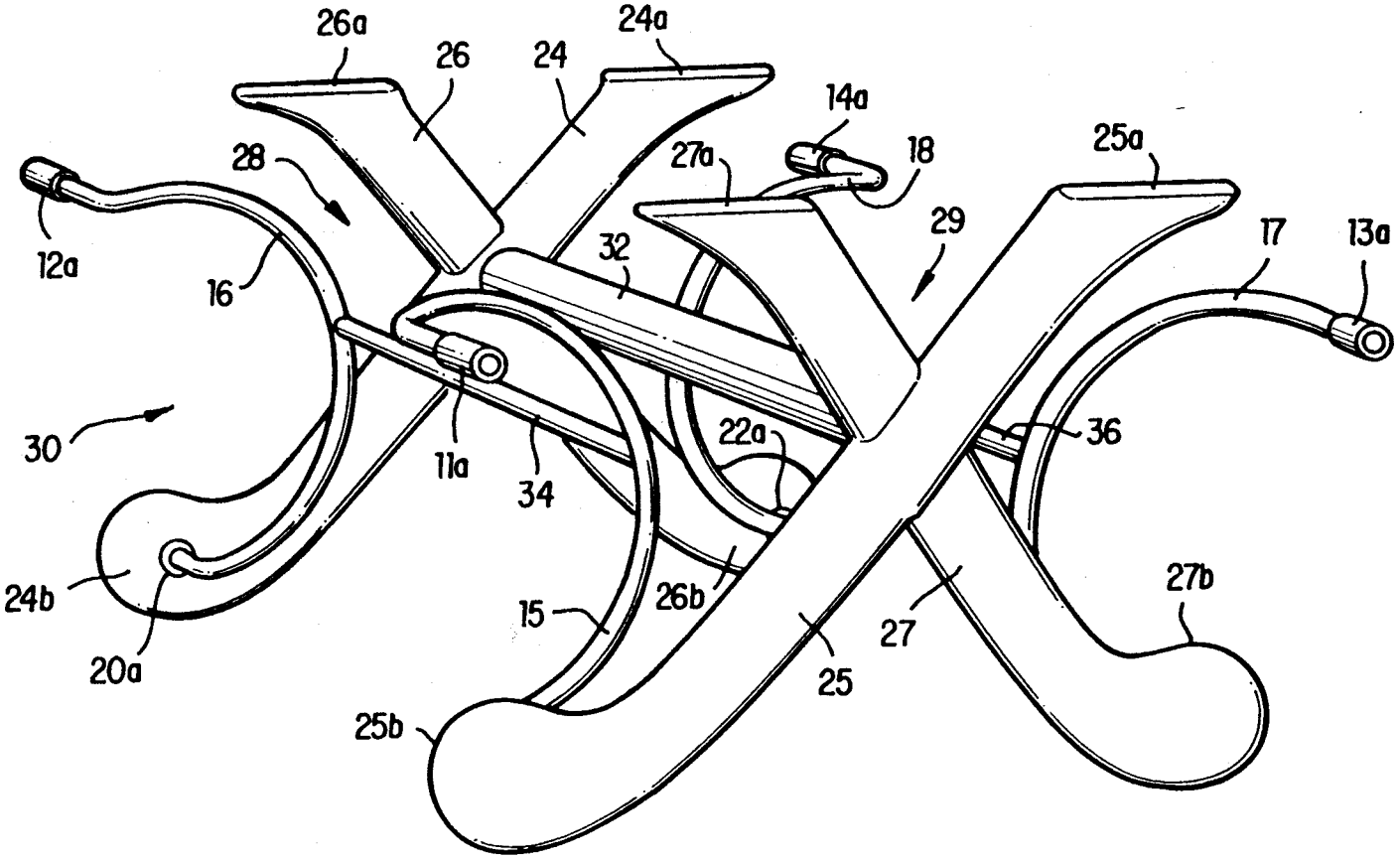

There is no other known equivalent mechanism which provides the performance, the utility and the advantages obtained by the instant invention. As far as Applicant is aware, such an apparatus which permits the design of a rocker chair having the motion, features and advantages provided by Applicant's invention has not been done before nor is it suggested anywhere in the cited references. Applicant is aware of no other teaching of the combinations of concepts, features and advantages of his apparatus. It should be noted that for a chair which incorporates the mechanism of Applicant, when the seat is moved rearward the arcs defined by the bottom ends of both the front and the rear hangers are substantially the same. The front to back spacing of the top ends of the front and the rear hangers is substantially the same as the front to back spacing of the bottom ends of the front and the rear hangers as is shown in FIG. 4 of Applicant's disclosure. While the top to bottom spacing as is shown in FIG. 4 is substantially the same for the front hangers and the rear hangers, it is not necessary that they be equal in order to obtain the motion and the advantages of Applicant's invention. There may be reasons involving the chair design to have the top to bottom spacing of the rear hangers be less than (or even more than) the top to bottom spacing for the front hangers.

What Applicant has invented and disclosed is certainly very useful and is a significant advance over the prior art. In many of the known prior art rockers, when the seat is moved rearward, the bottom end of the rear hangers drops down while the bottom end of the front pair of hangers raises upward. Such a motion is one which may have some dangerous consequences in that the rocker may easily tip over.

It is thought that the swing rocker apparatus of the present invention and many of its attendant advantages is understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A swing rocker apparatus adapted for attachment to a furniture piece said furniture piece having a base assembly and an upper portion assembly whereby said base assembly is in fixed position relative to a surface upon which said base assembly rests and said upper portion assembly is movable relative to said base assembly said rocker apparatus comprising:

four base assembly low rotational friction attaching means adapted to be securely affixed to said base assembly;

two pairs of hanger members a front pair and a rear pair each pair held in spaced relationship by a front hanger stretcher and a rear hanger stretcher, each of the four upper ends of said hanger members rotationally attached to said four base assembly attaching means affixed to said base assembly, each hanger member of said two pairs of hanger members being configured so that when they are attached to said furniture piece said piece will be free of spaces defined by moving components which spaces are sufficiently large whereby injury to small body parts does not occur;

a right and a left side frame each comprising a first and second side frame member said right and left side frames held in spaced relationship by a side frame stretcher, each of four bottom inward facing surfaces of said pairs of first and second side members having affixed thereto a frame member low rotational friction attaching means each of said four frame member attaching means adapted to receive a bottom end of one of said four hanger members and each of said first and second side frame members having an attaching surface which surface is rigidly affixed to said upper portion assembly;

said two pairs of hanger members each have an arcuately configured portion with an inward directed radius of curvature and said arcuate portion of said hanger members being located inwardly of said four frame member attaching means by a predetermined distance; and a front to back spacing of said top ends of said front and rear hangers being substantially the same as a front to back spacing of said bottom ends of said front and rear hangers.

2. The swing rocker apparatus for attachment to a furniture piece according to claim 1 wherein said right and left side frames are each configured in the shape of an X member and said side frame stretcher is attached, at each of its ends, to a cross-over of each of said side frame X member.

3. The swing rocker apparatus for attachment to a furniture piece according to claim 1 wherein said two pairs of hanger members are made from material selected from the group consisting of wood, steel, aluminum and rigid polymers.

4. The swing rocker apparatus for attachment to a furniture piece according to claim 1 wherein said low rotational friction

5. The swing rocker apparatus for attachment to a furniture piece according to claim 1 further comprising means to limit the rearward excursion of said upper portion assembly; and wherein said two pairs of hanger members are made from steel.

6. In an improvement for a rocker furniture piece having a seat back assembly; a base assembly having conventional legs and stretcher members; right and left side base members; a seat having an under side thereof; said improvement comprising:

four base assembly low rotational friction attaching means adapted to be securely affixed to said base assembly each said leg having a lower end which will contact said surface upon which said base assembly rests;

two pairs of hanger members a front pair and a rear pair each pair held in spaced relationship by a front hanger stretcher and a rear hanger stretcher, each of the four upper ends of said hanger members rotationally attachable to said four base assembly attaching means affixed to said base assembly, each hanger member of said two pairs of hanger members being configured so that when they are attached to said furniture piece said piece will be free of spaces defined by moving components which spaces are sufficiently large whereby injury to small body parts does not occur;

a right and a left side frame each comprising a first and second side frame member said right and left side frames held in spaced relationship by a side frame stretcher, each of four bottom inward facing surfaces of said pairs of first and second side members having affixed thereto a frame member low rotational friction attaching means each of said four frame member attaching means adapted to receive a bottom end of one of said four hanger members and each of said first and second side frame members having an attaching surface which surface is rigidly affixed to said upper portion assembly;

said two pairs of hanger members each have an arcuately configured portion with an inward directed radius of curvature and said arcuate portion of said hanger members being located inwardly of said four frame member attaching means by a predetermined distance; and a front to back spacing of said top ends of said front and rear hangers being substantially the same as a front to back spacing of said bottom ends of said front and rear hangers.

7. The improved rocker furniture piece according to claim 6 wherein said right and left side frames are each configured in the shape of an X member and said side frame stretcher is attached, at each of it's ends, to a cross-over of each of said side frame X member.

8. The improved rocker furniture piece according to claim 6 wherein said two pairs of hanger members are made from material selected from the group consisting of wood, steel, aluminum and rigid polymers.

9. The improved rocker furniture piece according to claim 6 further comprising means to limit the rearward excursion of said upper portion assembly; and wherein said low rotational friction attaching means are bearing assemblies.

10. The improved rocker furniture piece according to claim 6 wherein said two pairs of hanger members are made from steel.

* * * * *